US006674690B2

(12) United States Patent
Malik et al.

(10) Patent No.: US 6,674,690 B2
(45) Date of Patent: Jan. 6, 2004

(54) ACOUSTIC TRANSDUCER DAMPING METHOD

(75) Inventors: Vipin Malik, Houston, TX (US); Keith V. Groeschel, Houston, TX (US)

(73) Assignee: Daniel Industries, Inc., Houston, TX (US)

( * ) Notice: Subject to any disclaimer, the term of this patent is extended or adjusted under 35 U.S.C. 154(b) by 0 days.

(21) Appl. No.: 09/998,803

(22) Filed: Nov. 1, 2001

(65) Prior Publication Data

US 2003/0081505 A1 May 1, 2003

(51) Int. Cl.[7] ..... G10K 11/16
(52) U.S. Cl. ..... 367/137; 367/903
(58) Field of Search ..... 367/137, 903

(56) References Cited

U.S. PATENT DOCUMENTS 4,507,762 A * 3/1985 Meyer et al. ..... 367/137
4,701,893 A * 10/1987 Muller et al. ..... 367/137
5,144,592 A * 9/1992 Bonis ..... 367/137
5,983,730 A 11/1999 Freund et al. ..... 73/861.28

* cited by examiner

*Primary Examiner*—Daniel T. Pihulic
(74) *Attorney, Agent, or Firm*—Conley Rose, P.C.

(57) ABSTRACT

An acoustic device that places existing components in a damping pattern after transmitting an acoustic signal. In one embodiment, the device comprises a transistor bridge and an acoustic transducer. The transistor bridge is coupled between two predetermined voltages having a voltage difference, and the acoustic transducer is coupled between the arms of the transistor bridge. The transistor bridge enters a damping configuration after applying an excitation pattern to the acoustic transducer. In the damping configuration, the input terminals of the transistor bridge are preferably grounded. In applying the excitation pattern, the transistor bridge preferably applies the voltage difference to the acoustic transducer in alternate polarities. In a preferred embodiment, the acoustic transducer includes a transformer having a primary winding coupled between the arms of the transistor bridge, and further includes a piezoelectric crystal coupled to a secondary winding of the transformer.

22 Claims, 4 Drawing Sheets

ACOUSTIC TRANSDUCER DAMPING METHOD

BACKGROUND OF THE INVENTION

1. Field of the Invention

This invention generally relates to systems and methods for driving piezoelectric transducers. More specifically, this invention relates to a method for damping residual vibrations of a piezoelectric transducer after excitation.

2. Description of the Related Art

Many measuring techniques and devices require an accurate measurement of the time of flight of a signal. One high-accuracy time-of-flight measurement technique is taught in U.S. Pat. No. 5,983,730 ("Freund"), which is hereby incorporated by reference. The required degree of accuracy may be application dependent, but any economical technique of improving accuracy is generally desirable.

Freund describes a method for performing accurate time of flight measurements of acoustic signals. His and other methods may be improved by damping the acoustic transducer to shorten the acoustic signal. Various benefits may be realized by a system using a shorter acoustic signal. One of the benefits could be easier identification of the time of arrival. Because unwanted signal portions are eliminated, less processing is required to identify the time of arrival. Further, because less extraneous energy is transmitted into the system, the background noise due to echoes may be reduced. Still further, shorter pulses allow for quicker re-use of the transducer, thereby increasing the potential measurement rate of the system.

Unfortunately, existing transducer damping methods generally require additional components to dissipate the residual energy. In addition to increasing the cost, the damping components may reduce the amplitude of the transmitted signal. A solution that avoids these drawbacks would be desirable.

SUMMARY OF THE INVENTION

The problems outlined above are in large measure addressed by a device that places existing components in a damping pattern after transmitting an acoustic signal. In one embodiment, the device comprises a transistor bridge and an acoustic transducer. The transistor bridge is coupled between two predetermined voltages having a voltage difference, and the acoustic transducer is coupled between the arms of the transistor bridge. The transistor bridge enters a damping configuration after applying an excitation pattern to the acoustic transducer. In the damping configuration, the input terminals of the transistor bridge are preferably grounded. In applying the excitation pattern, the transistor bridge preferably applies the voltage difference to the acoustic transducer in alternate polarities. In a preferred embodiment, the acoustic transducer includes a transformer having a primary winding coupled between the arms of the transistor bridge, and further includes a piezoelectric crystal coupled to a secondary winding of the transformer.

BRIEF DESCRIPTION OF THE DRAWINGS

A better understanding of the present invention can be obtained when the following detailed description of the preferred embodiment is considered in conjunction with the following drawings, in which.

Figure 1:
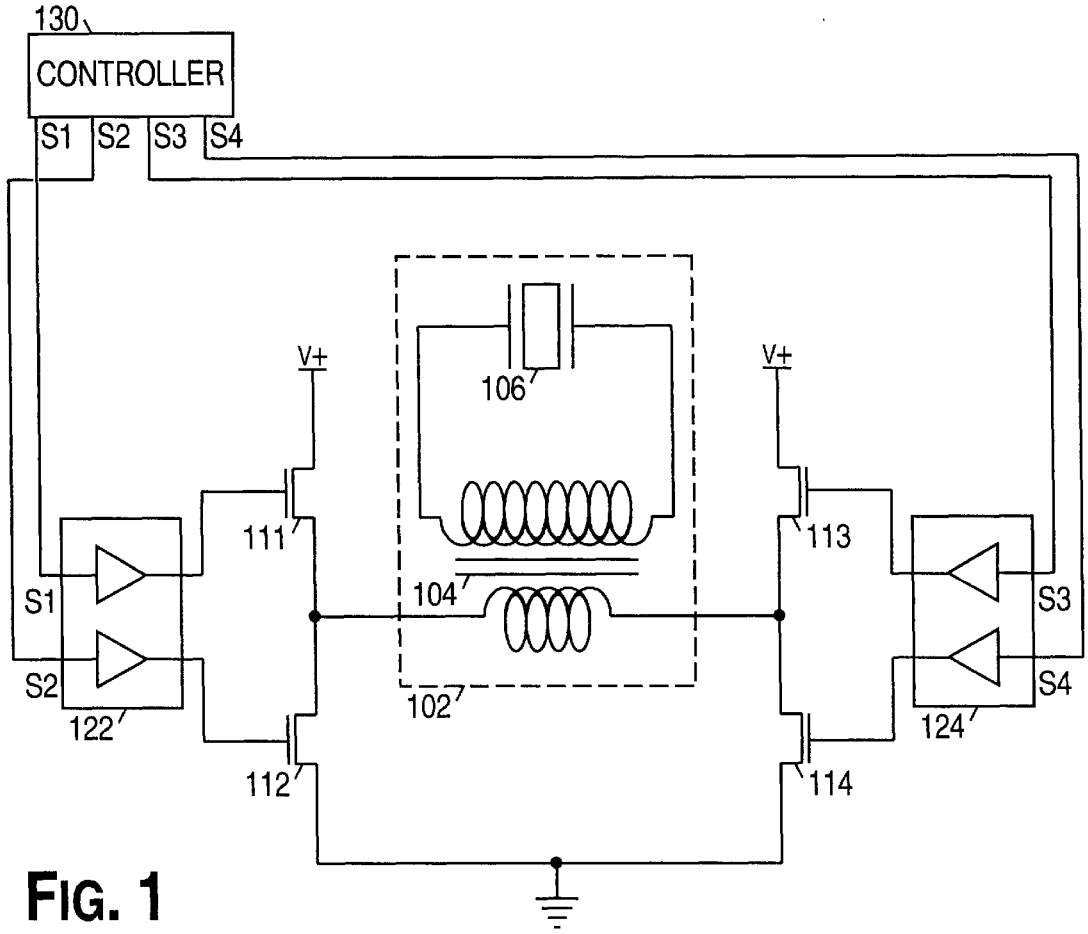
FIG. 1 shows a schematic of a preferred driver circuit for an acoustic transducer.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

It is noted that the term "acoustic" as used in this application is defined to include sonic, ultrasonic, seismic, and any other form of traveling pressure waves.

DETAILED DESCRIPTION OF THE PREFERRED EMBODIMENT

Turning now to the figures, FIG. 1 shows an acoustic transducer 102 having a step-up transformer 104 and a piezoelectric crystal 106. The piezoelectric crystal 106 is coupled to the secondary winding of transformer 104, and the terminals of the transformer's primary winding serve as the input terminals to acoustic transducer 102. In a preferred embodiment, the piezoelectric crystal may be a PZT-5A piezoelectric crystal from Keramos, Inc., or Morgan Matroc, which is rated for 125 kHz operation with a capacitance of about 150 pF. The transformer 104 may be a transformer from Sigma Electronics with a 10.5-turn primary winding and a 315.5-turn secondary winding. The primary winding may have a rated inductance of 250–350 uH and a rated resistance of 0.1–0.14 ohms. The secondary winding may have a rated inductance of 200–300 mH and a rated resistance of 30–40 ohms.

In an alternate preferred embodiment, the acoustic transducer 102 includes a PZT-5A piezoelectric crystal from Keramos, Inc., or Morgan Matroc, which is rated for 125 kHz operation with a capacitance of about 360 pF. The transformer may be a transformer from Sigma Electronics with a 10.5-turn primary winding and a 420.5-turn secondary winding. The primary winding may have a rated inductance of 250–350 uH and a rated resistance of 0.1–0.14 ohms. The secondary winding may have a rated inductance of 350–530 mH and a rated resistance of 50–75 ohms.

The acoustic transducer 102 is coupled between the arms of a MOSFET (metal-oxide-semiconductor field-effect transistor) bridge 111-114. One input terminal of the acoustic transducer 102 is coupled to a power voltage (V+) via transistor 111, and is coupled to a ground voltage via transistor 112. The other input terminal of acoustic transducer 102 is similarly coupled to the power voltage via transistor 113, and is coupled to ground via transistor 114. As explained further below, appropriate switching of transistors 111–114 causes the power voltage to be applied across the primary winding of transformer 104.

The transistors 111–114 in the MOSFET bridge are each controlled by respective signals S1, S2, S3, S4. A controller 130 operates in accordance with embedded software or a state machine to set the control signals S1–S4 as explained further below. The signals provided by controller 130 are typically logic-level signals (i.e. a logical "high" which, depending on the transistor technology, may be as little as about 0.8 volts or as much as about 5 volts), while the transistors 111–114 may require significantly higher voltages for effective switching. Line drivers 122 and 124 are provided to convert the signals S1–S4 from their logic-levels to effective switching levels. In one embodiment, the line drivers 122, 124 convert a 3.3 volt signal into a 15 volt signal.

Figure 2:
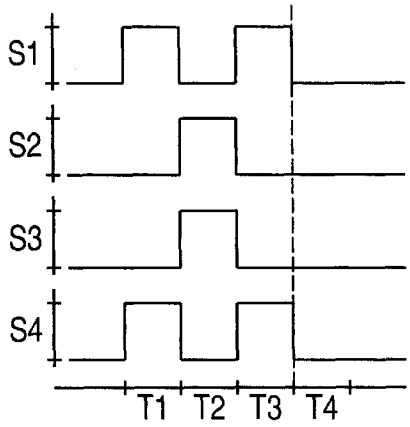
FIG. 2 shows a first set of driver signals in the preferred driver circuit.

Before an acoustic pulse is transmitted, each of the transistors 111–114 is switched off. To transmit an acoustic pulse, controller 130 asserts S1 and S4 (as shown in FIG. 2) for one time interval T1. This subjects the primary winding of transformer 104 to power voltage V+ in a left-to-right direction in FIG. 1. A current flows through the primary winding and induces a stepped-up voltage across the secondary winding. This voltage momentarily compresses the piezoelectric crystal 106. The controller 130 then de-asserts S1 and S4, and asserts S2 and S3 for a time interval T2. This subjects the winding of transformer 104 to the power voltage V+ in a right-to-left direction in FIG. 1. A current flows through the primary winding and induces a stepped-up voltage across the secondary winding in the direction opposite the previous voltage. This momentarily expands the piezoelectric crystal 106. The controller 130 then de-asserts S2 and S3, and re-asserts S1 and S4 for a time interval T3. This again momentarily compresses the piezoelectric crystal 106. The controller then de-asserts all signals S1–S4.

Figure 4:
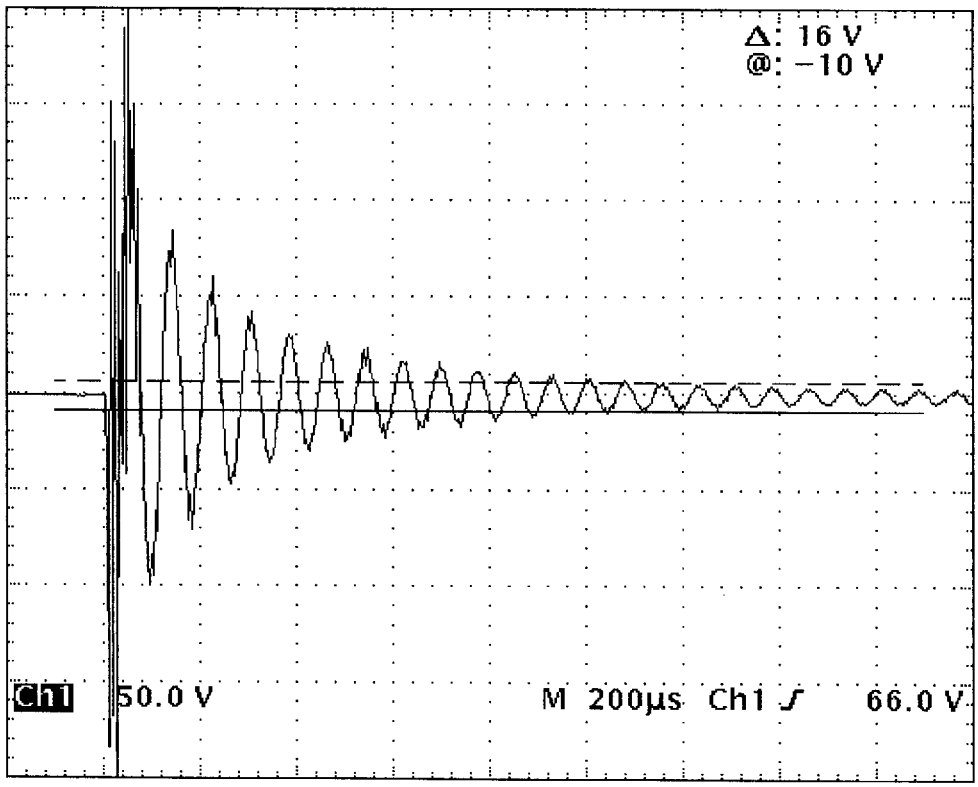
FIG. 4 shows an illustrative undamped transducer signal.
Figure 8:
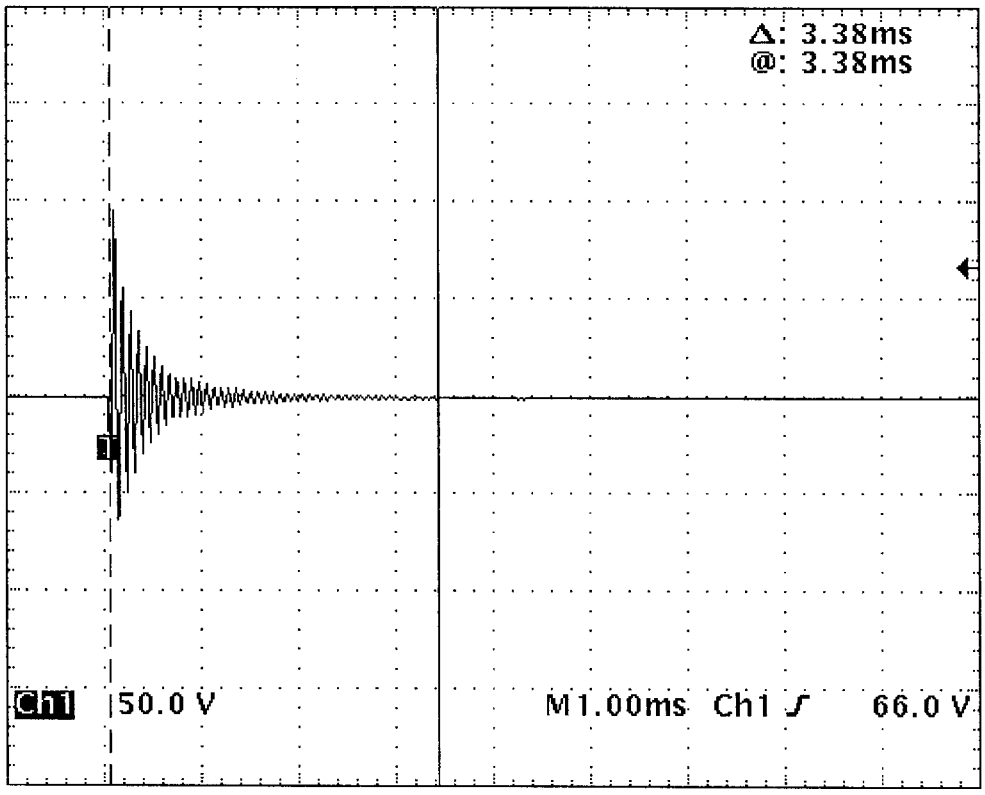
FIG. 8 shows the undamped transducer signal of FIG. 4 on a larger time scale.

The effect of this pattern of momentary compression, expansion, and compression is much like repeated striking of the crystal. The crystal vibrates in response, causing an acoustic wave to travel outward from the acoustic transducer 102. FIG. 4 shows the resulting voltage signal across the piezoelectric crystal 106. This voltage signal is indicative of the undamped vibrations of the crystal. The vertical scale in FIG. 4 is 50 volts/div and the horizontal scale is 200 significant oscillation of the crystal. The oscillation eventually dies out at about 3400 in FIG. 8).

Figure 3:
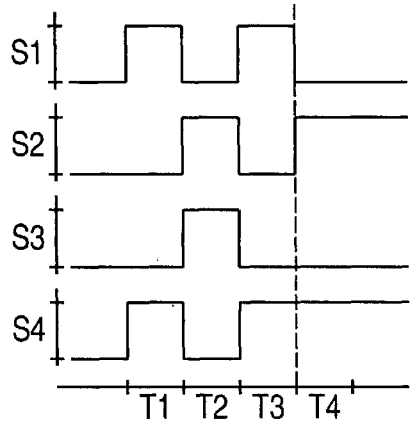
FIG. 3 shows an improved set of driver signals in the preferred driver circuit.

A method is now proposed for damping the vibration of the crystal 106 without adding components. In FIG. 3, the excitation pattern is the same as that described above for time intervals T1–T3. In time interval T4, the controller 130 de-asserts S1 and S3, and asserts S2 and S4. This "grounds" both input terminals of acoustic transducer 102. Any residual vibrational energy of the piezoelectric crystal 106 is translated into a current through the coils of the transformer 104. Any current flowing through the primary coil flows in a closed loop until dissipated by the internal resistance of the transformer coils and transistors 112, 114. In this manner, the internal resistances quickly dissipate the vibrational energy of the crystal 106.

Figure 5:
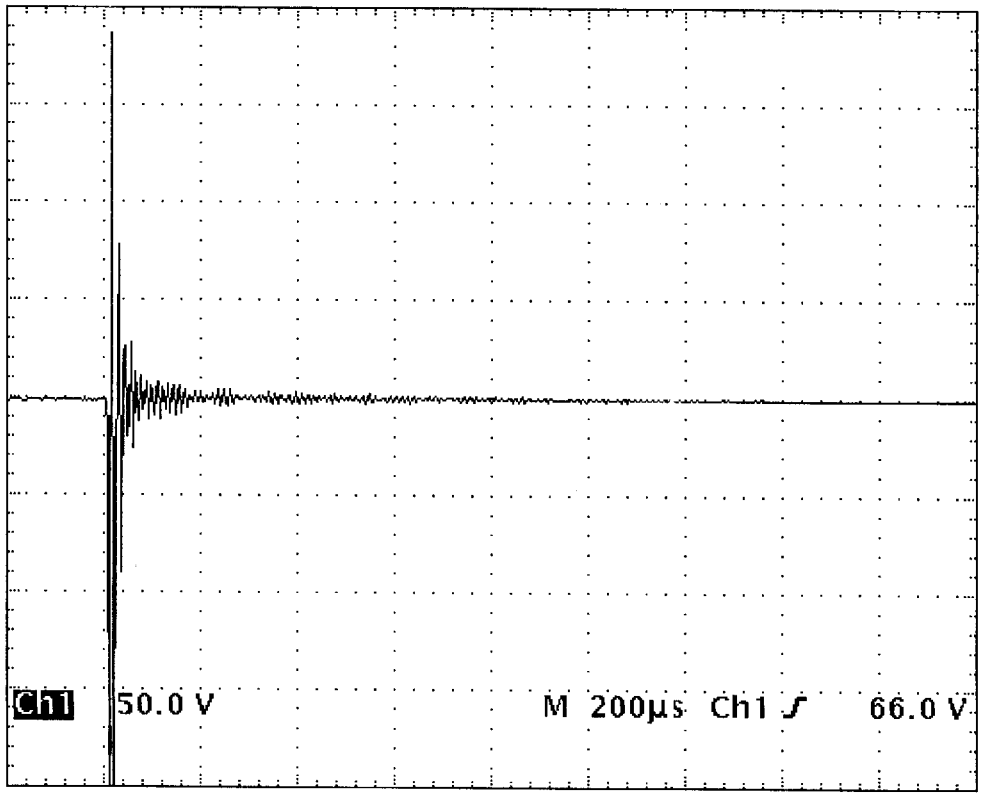
FIG. 5 shows an illustrative damped transducer signal.

FIG. 5 shows the voltage signal across the piezoelectric crystal 106 when the excitation pattern of FIG. 3 is used. Note that damping causes the oscillations die out at about 1350 ms after the excitation pattern is applied, the residual oscillations have fallen to an insignificant level, whereas in FIG. 4 they are still about 16 volts. After the residual energy has been substantially dissipated (in one embodiment, between about 200 and 1200 de-asserted. Alternatively, they may remain asserted until the next excitation pattern is applied.

Figure 6:
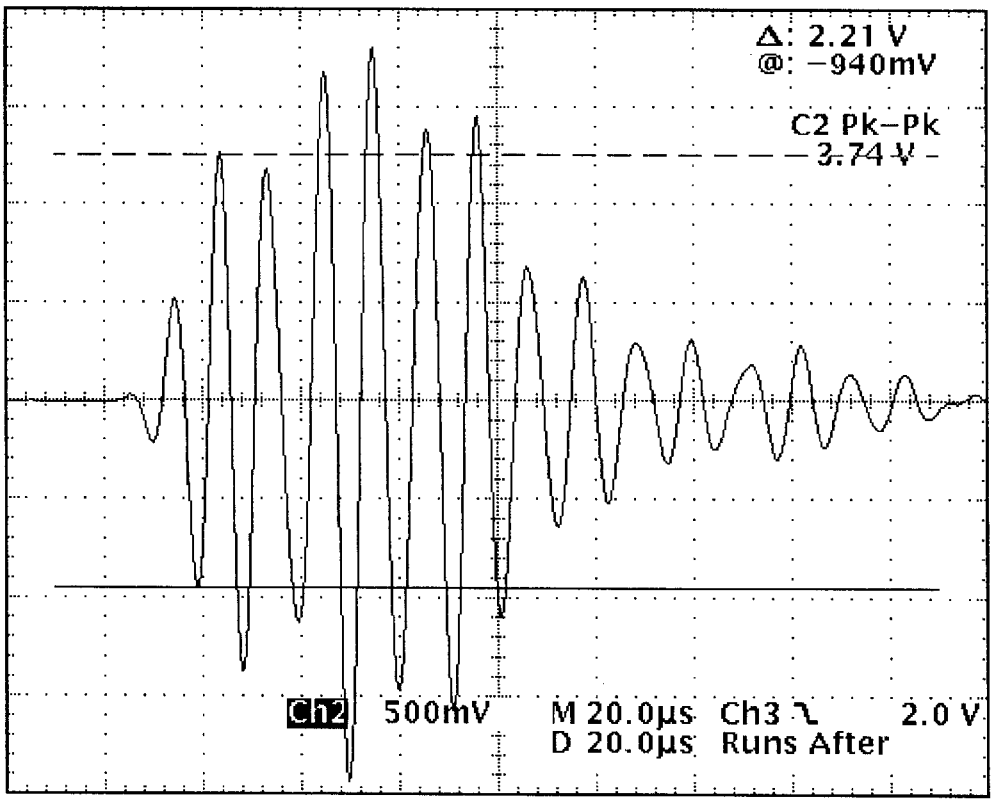
FIG. 6 shows an illustrative signal from a receive transducer when the transmit transducer is undamped.
Figure 7:
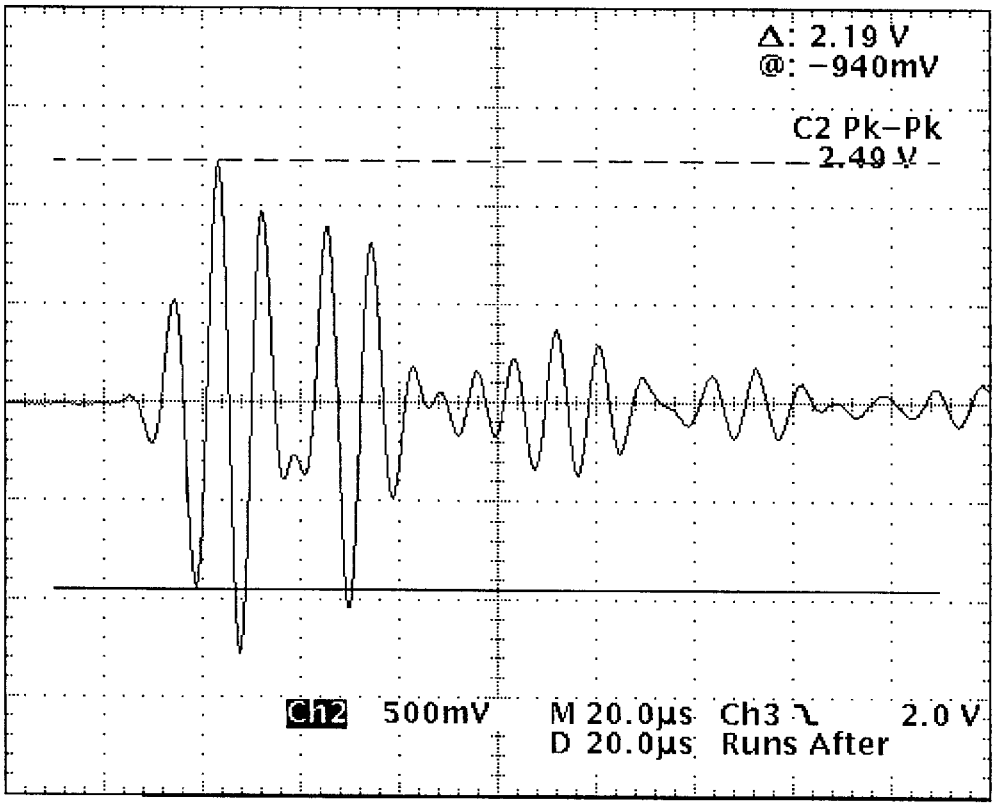
FIG. 7 shows an illustrative signal from a receive transducer when the transmit transducer is damped.

In a system that transmits bi-directionally (e.g., a signal is transmitted from transducer A to transducer B, and then a return signal is transmitted to transducer B to transducer A), the transducers are used for both transmitting and receiving. FIG. 6 shows an illustrative receive signal when the transmitted signal is undamped, and FIG. 7 shows an illustrative receive signal when the transmitted signal is damped. The initial portion of the signal is essentially unchanged, and the signal strength in the middle portion of the received damped signal is substantially reduced. Note that the signal is shorter, i.e. it rises up and dies out more quickly, when the transmitter is damped. The peak is near the beginning of the signal where the measurements are preferably made, rather than in the middle. This allows for less processing effort when calculating time of arrival.

For optimum sensitivity in a bidirectional system, the residual vibrations from transmitting a signal should be allowed to die out before the return signal is received. In such a system, damping allows for a measurement cycle time that is less than 40% of the measurement cycle time of the undamped system. This translates into measurement frequency that is up to 250% higher.

As an alternative to grounding both input terminals through transistors 112 and 114, both terminals may be coupled to power voltage V+ by turning on transistors 111 and 113. This similarly provides a closed current path for dissipating residual vibrational energy.

The excitation pattern described above is illustrative only and is not limiting. A greater or lesser number of pulses may be applied to the acoustic transducer to excite vibrations in the crystal. For example, the controller may apply the excitation signals in T1 and T2 only, before applying a damping signal configuration in T3.

Numerous variations and modifications will become apparent to those skilled in the art once the above disclosure is fully appreciated. It is intended that the following claims be interpreted to embrace all such variations and modifications.

What is claimed is:

1. A circuit that comprises:

an acoustic transducer having a first input terminal and a second input terminal;

a transistor bridge having:

a first transistor coupled between the first input terminal and a power voltage;

a second transistor coupled between the first input terminal and a ground voltage;

a third transistor coupled between the second input terminal and the power voltage; and a fourth transistor coupled between the second input terminal and the ground voltage; and a controller that provides a set of signals to control the transistors, wherein the controller is configured to provide said set of signals in a damping configuration immediately after providing said set of signals in an excitation pattern.

2. The circuit of claim 1, wherein the acoustic transducer includes:

a transformer having a primary winding coupled between the first and second input terminals.

3. The circuit of claim 2, wherein the acoustic transducer further includes:

a piezoelectric crystal coupled to a secondary winding of the transformer.

4. The circuit of claim 1, wherein the set of signals includes a control signal for each transistor in the transistor bridge, and wherein the damping configuration is assertion of the control signals for the second and fourth transistors and de-assertion of the control signals for the first and third transistors.

5. The circuit of claim 4, wherein the excitation pattern includes:

assertion of the control signals for the first and fourth transistors and de-assertion of the control signals second and third transistors during a first time interval; and de-assertion of the control signals for the first and fourth transistors and assertion of the control signals for the second and third transistors during a second time interval.

6. The circuit of claim 5, wherein the excitation pattern further includes:

assertion of the control signals for the first and fourth transistors and de-assertion of the control signals second and third transistors during a third time interval.

7. The circuit of claim 1, wherein the set of signals includes a control signal for each transistor in the transistor bridge, and wherein the damping configuration is de-assertion of the control signals for the second and fourth transistors and assertion of the control signals for the first and third transistors.

8. A method of driving an acoustic transducer to produce a shortened acoustic signal, the method comprising:

applying an excitation pattern to a transistor bridge, wherein the acoustic transducer is coupled between arms of the transistor bridge; and applying a damping configuration to the transistor bridge immediately after applying the excitation pattern.

9. The method of claim 8, wherein the damping configuration causes the transistor bridge to couple input terminals of the acoustic transducer to ground.

10. The method of claim 8, wherein the damping configuration causes the transistor bridge to couple input terminals of the acoustic transducer to a predetermined voltage.

11. The method of claim 9, wherein the excitation pattern causes the transistor bridge to couple one of the input terminals to a first voltage while coupling another of the input terminals to a second different voltage, and wherein the excitation pattern further causes the transistor bridge to alternate the first and second voltages.

12. The method of claim 8, wherein the acoustic transducer includes:

a transformer having a primary winding coupled between the arms of the transistor bridge; and a piezoelectric crystal coupled to a secondary winding of the transformer.

13. A device that comprises:

a transistor bridge coupled between two predetermined voltages having a voltage difference; and an acoustic transducer coupled between arms of the transistor bridge, wherein the transistor bridge enters a damping configuration after applying an excitation pattern to the acoustic transducer such that the acoustic transducer produces a shortened acoustic signal.

14. The device of claim 13, wherein the transistor bridge applies one of the predetermined voltages to both input terminals of the acoustic transducer when the transistor bridge is in the damping configuration.

15. The device of claim 14, wherein the transistor bridge applies the voltage difference in alternate polarities to the acoustic transducer when the transistor bridge is applying the excitation pattern.

16. The device of claim 15, wherein the acoustic transducer includes:

a transformer having a primary winding coupled between the arms of the transistor bridge; and a piezoelectric crystal coupled to a secondary winding of the transformer.

17. A system comprising:

an acoustic transducer having a first input terminal and a second input terminal, the acoustic transducer transmits a damped acoustic signal;

a transistor bridge having:

a first transistor coupled between the first input terminal and a power voltage;

a second transistor coupled between the first input terminal and a ground voltage;

a third transistor coupled between the second input terminal and the power voltage; and a fourth transistor coupled between the second input terminal and the ground voltage; and a controller that provides control signals to the transistors, wherein the controller is configured to provide a set of damping control signals immediately after providing a set of excitation control signals such that the transducer transmits a damped acoustic signal.

18. The system of claim 17, wherein the system includes:

a transformer having a primary winding coupled between the first and second input terminals of the acoustic transducer.

19. The system of claim 18, wherein the acoustic transducer further includes:

a piezoelectric crystal coupled to a secondary winding of the transformer.

20. The system of claim 17, wherein the set of excitation control signals:

activates the first and fourth transistors and deactivates the second and third transistors during a first time interval; and deactivates the first and fourth transistors and activates the second and third transistors during a second time interval.

21. The system of claim 20, wherein the set of excitation signals:

activates the first and fourth transistors and deactivates the second and third transistors during a third time interval.

22. The system of claim 17, wherein the set of damping control signals activates the second and fourth transistors and deactivates the first and third transistors during a fourth time interval.

* * * * *